US006808777B2

(12) United States Patent
Andersson et al.

(10) Patent No.: US 6,808,777 B2
(45) Date of Patent: Oct. 26, 2004

(54) FLOORING

(75) Inventors: Kjell Andersson, Anderstorp (SE); Roger Davidsson, Anderstorp (SE)

(73) Assignee: AB Golvabia, Anderstorp (SE)

( * ) Notice: Subject to any disclaimer, the term of this patent is extended or adjusted under 35 U.S.C. 154(b) by 128 days.

(21) Appl. No.: 09/809,448

(22) Filed: Mar. 15, 2001

(65) Prior Publication Data

US 2001/0024707 A1 Sep. 27, 2001

Related U.S. Application Data

(63) Continuation-in-part of application No. 09/297,761, filed on May 7, 1999, now Pat. No. 6,670,019.

(30) Foreign Application Priority Data

Nov. 8, 1996 (SE) ..... 9604105
Oct. 24, 1997 (SE) ..... PCT/SE97/01780

(51) Int. Cl.[7] ..... E04F 13/08; E04F 15/022

(52) U.S. Cl. ..... 428/47; 428/45; 428/48; 428/57; 428/58; 428/81; 52/390; 52/392; 403/345

(58) Field of Search ..... 52/390, 392; 403/345; 428/45, 57, 60, 90, 47, 48, 49, 50, 44, 58, 81, 82, 83

(56) References Cited

U.S. PATENT DOCUMENTS 2,430,200 A * 11/1947 Wilson ..... 52/588.1
3,535,844 A * 10/1970 Glaros ..... 52/592.1
4,104,840 A * 8/1978 Heintz et al. ..... 52/309.9
6,006,486 A * 12/1999 Moriau et al. ..... 52/589.1
6,029,416 A * 2/2000 Andersson ..... 52/592.1
6,209,278 B1 * 4/2001 Tychsen ..... 52/592.4
6,332,733 B1 * 12/2001 Hamberger et al. ..... 403/329
6,385,936 B1 * 5/2002 Schneider ..... 52/589.1
6,526,719 B2 * 3/2003 Pletzer et al. ..... 52/592.2
6,722,809 B2 * 4/2004 Hamberger et al. ..... 403/329

FOREIGN PATENT DOCUMENTS

WO WO 9623942 A1 * 8/1996 ..... E04F/15/02

* cited by examiner

*Primary Examiner*—Cheryl A. Juska
(74) *Attorney, Agent, or Firm*—Bachman & LaPointe, P.C.

(57) ABSTRACT

An arrangement which comprises: first and second panel-shaped pieces of flooring for joining together, said pieces resting on a sub-floor and having profiles along mutually meeting edge portions which, on the first piece, consist of a groove and a projection located thereunder, and on the second piece a tongue insertible in the groove, and also a recess accommodating the projection; wherein said projection, at its outer, free edge, is of greater thickness transversely of the plane of extent of the flooring piece than at its inner edge connected with remaining parts of the piece; and wherein the underside of the projection lies flush with the remainder of the underside of the flooring piece.

10 Claims, 5 Drawing Sheets

FLOORING

CROSS REFERENCE TO RELATED APPLICATION

This application is a Continuation-In-Part of U.S. patent application Ser. No. 09/297,761, filed May 7, 1999, now U.S. Pat. No. 6,670,019.

BACKGROUND OF THE INVENTION

The present invention relates to an arrangement for joining together first and second panel-shaped pieces of flooring resting on a sub-floor, the pieces having profiles along mutually meeting edge portions which, on the first piece, consist of a groove and a projection located thereunder, and on the second piece a tongue insertible in the groove, and also a recess accommodating the projection.

The present invention has for its object to improve the arrangement intimated by way of introduction such that it can be manufactured simply and rationally, that it will have an improved unifying effect between adjacent pieces of flooring material even if the flock or other unifying material were to be damaged, and that, in addition, laying of the flooring material is simplified. In particular, the present invention has for its object to design the arrangement such that the unifying force between two joined pieces of flooring material increases if an attempt is made to displace them away from one another when they are lying flat on a sub-floor.

SUMMARY OF THE INVENTION

The objects forming the basis of the present invention will be attained if the arrangement intimated by way of introduction is characterized in that the projection, at its outer, free edge, is of greater thickness transversely of the plane of extent of the flooring piece than at its inner edge connected with remaining parts of the piece, and that the underside of the projection lies flush with the remainder of the underside of the flooring piece.

BRIEF DESCRIPTION OF THE ACCOMPANYING DRAWINGS

The present invention will now be described in greater detail hereinbelow with particular reference to the accompanying drawings. In the accompanying drawings.

DESCRIPTION OF PREFERRED EMBODIMENT

In the following description, use will be made of directional and positional disclosures such as upwards, downwards, upper and lower. These refer to those positions which the pieces of flooring material assume when they are located in the position of use on a sub-floor. Outwards, inwards, relate to directions in relation to the central portion of a piece of flooring material. Thus, outwards is taken to signify out towards or out from the edge of a piece, i.e. away from its central region, all seen in the plane of extent of the flooring piece.

Figure 1:
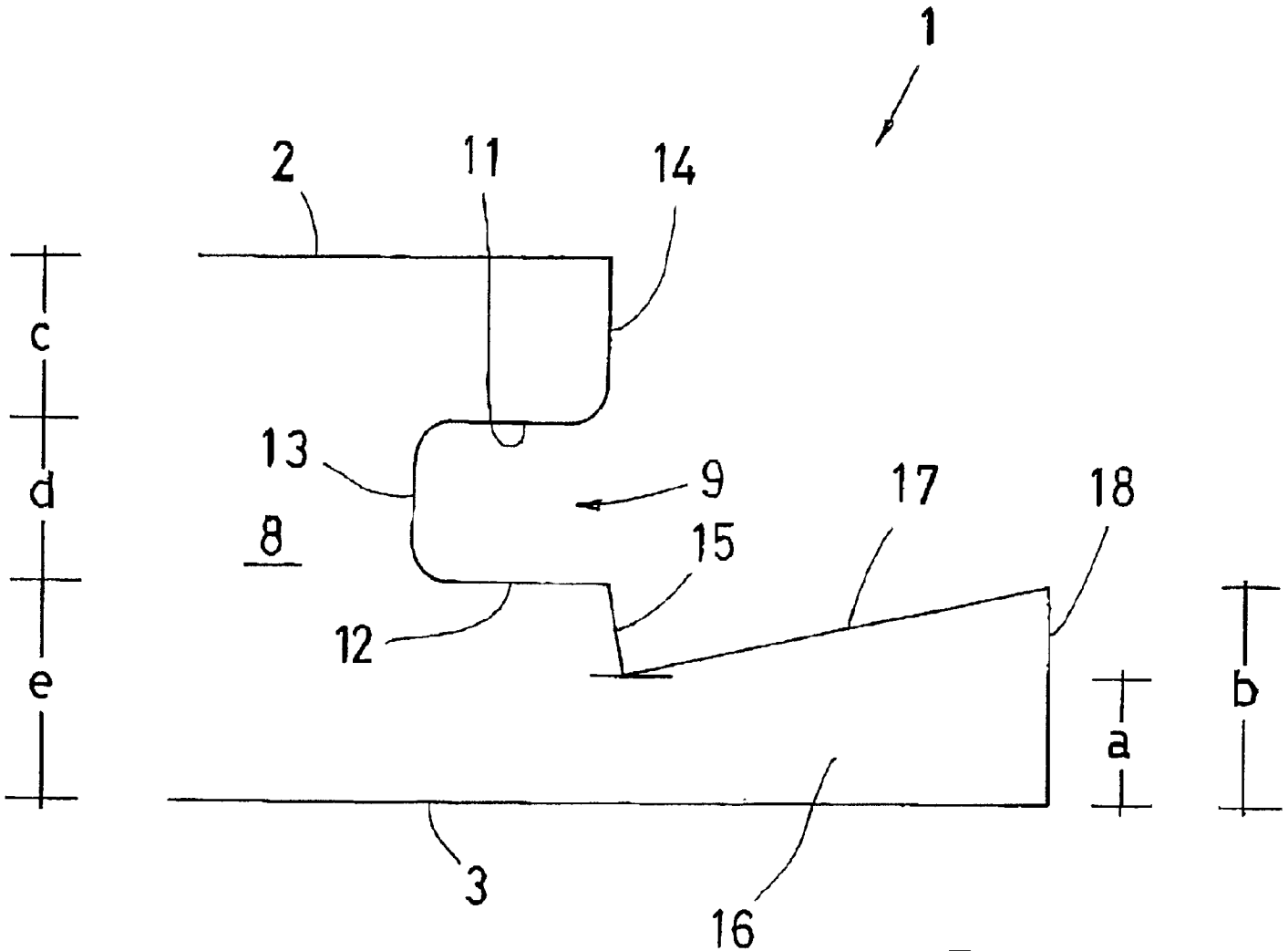
FIG. 1 is a partial cross section or end elevation of an edge portion of a first piece of flooring.
Figure 2:
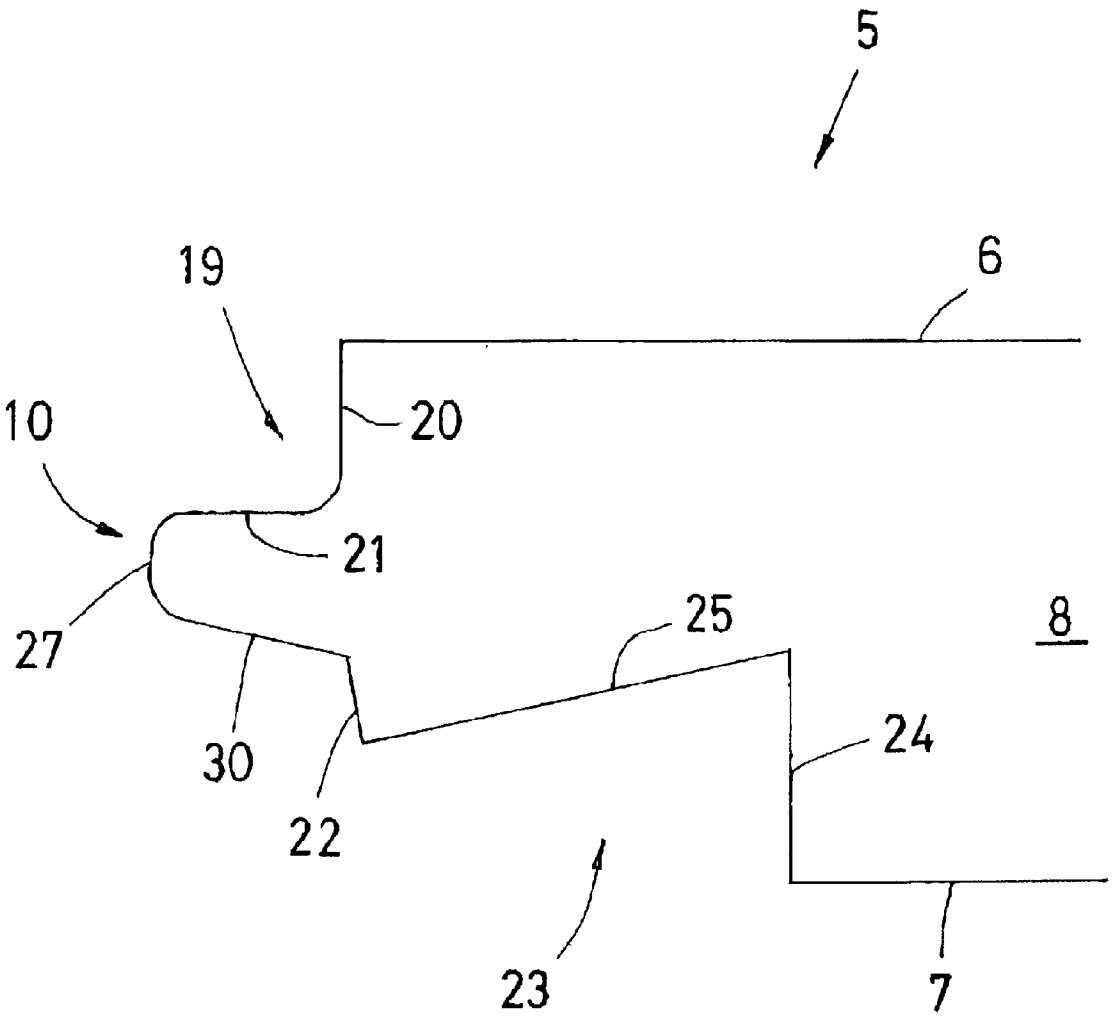
FIG. 2 is a corresponding partial cross section or end elevation of a second piece of flooring material intended to be joined together with the first.
Figure 3:
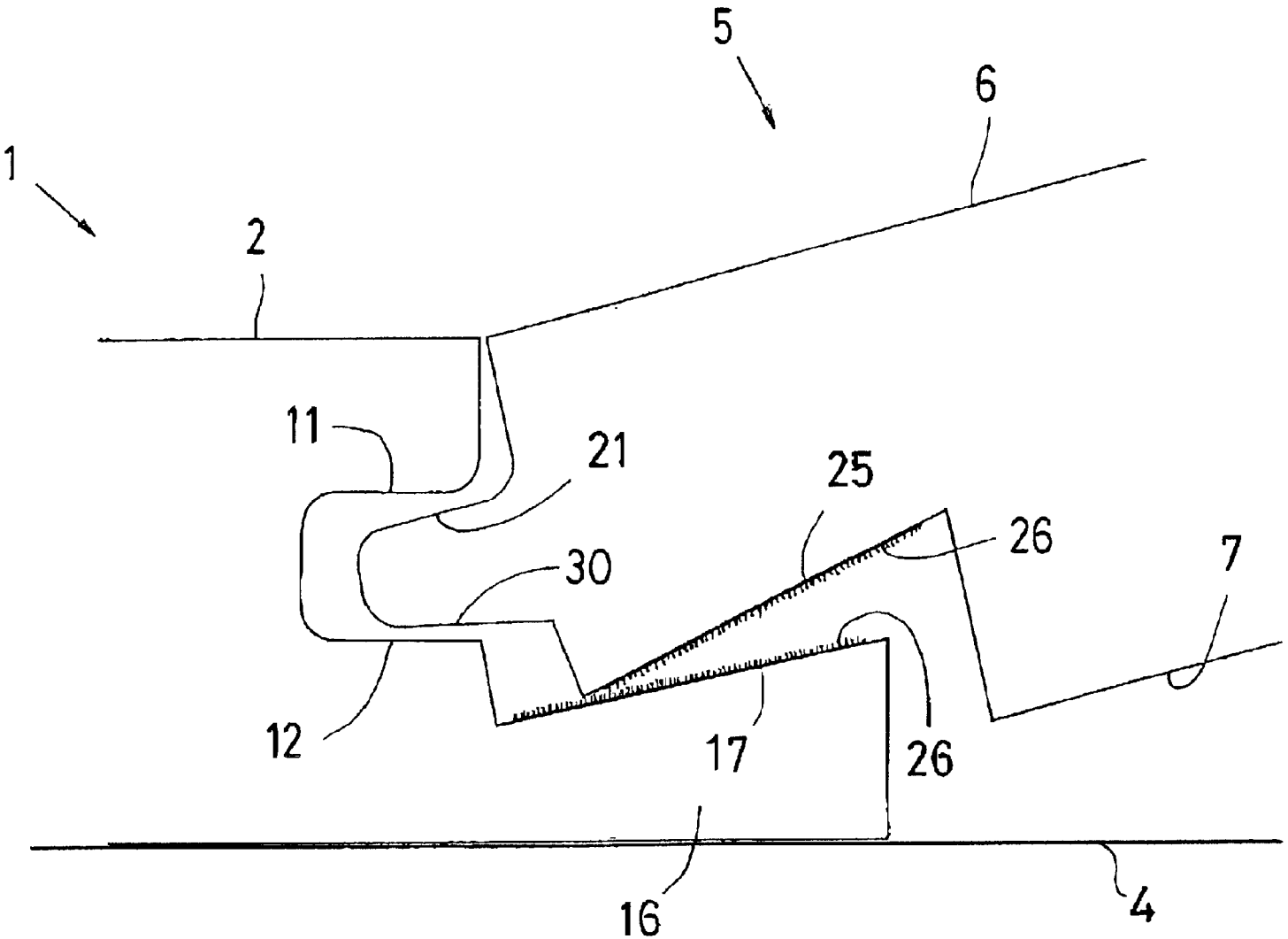
FIG. 3 shows two pieces of flooring material of the type shown in FIGS. 1 and 2 at the beginning of a joining operation.
Figure 4:
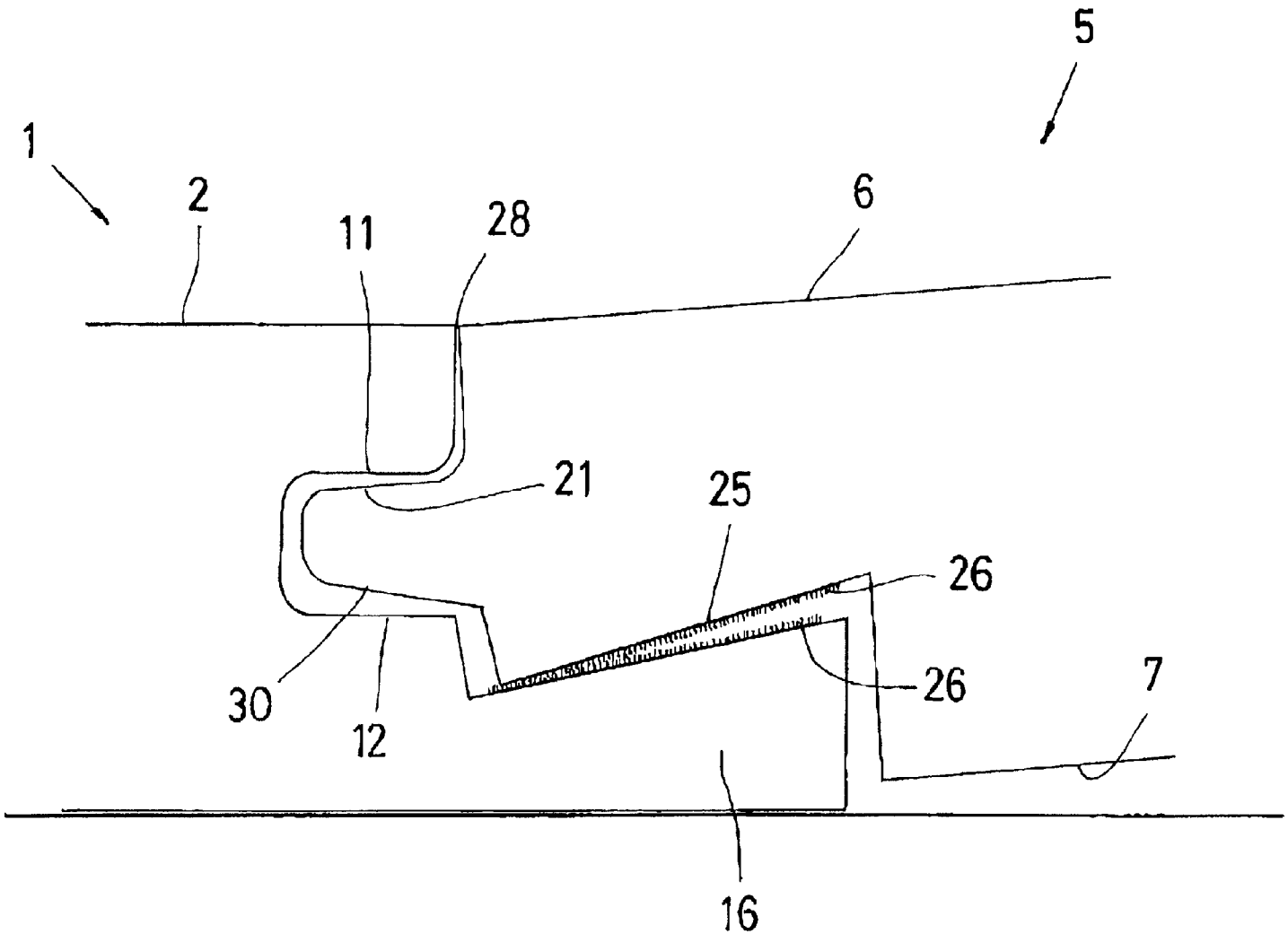
FIG. 4 shows the pieces of flooring material according to FIG. 3 after a part of the joining operation.
Figure 5:
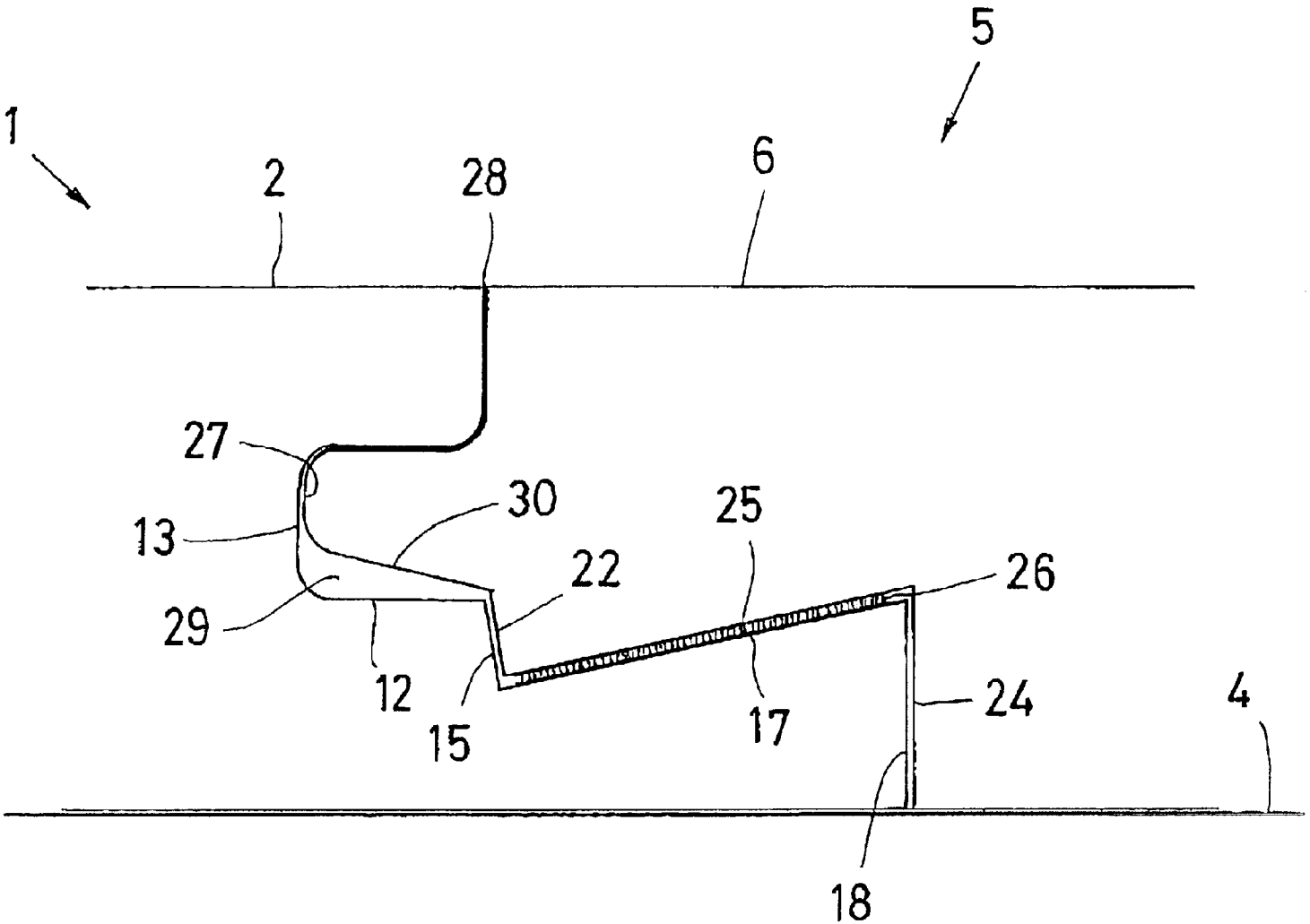
FIG. 5 shows the flooring material according to FIGS. 3 and 4 after completion of the joining.

FIG. 1 shows an end elevation or a vertical section through an edge portion of a first piece 1 of flooring material, which has an upper surface 2 and a lower surface 3, where the lower surface is intended to rest on a sub-floor 4 (FIGS. 3–5).

Analogous with that described with reference to FIG. 1, a second piece 5 of flooring material has an upper surface 6 and a lower surface 7 which is intended to rest on the sub-floor 4.

The upper surfaces 2 and 6 are the upwardly facing surfaces of the flooring material which have been provided with an aesthetically attractive pattern or color and which, moreover, are designed to function as a wearing course or surface. While not being apparent from the drawings, there is suitably provided, on the lower surfaces 3 and 7, some form of barrier layer which, in dampness variations in the core material 8 of the flooring material, rigidify so that the core material, by being united with the decorative layer or wearing surface, will not be warped.

The decorative layer, the wearing surface, the barrier layer and the core material 8 are produced in accordance with known, conventional techniques.

The first piece of flooring material has, along one edge portion, a profile which includes a groove 9. Correspondingly, the second piece 5 of flooring material has, along an edge portion which is intended to be joined together with the edge portion of the first piece of flooring material, a tongue 10 which may be accommodated in the groove 9.

The groove 9 in the first piece 1 of flooring material has an upper defining surface 11, a lower defining surface 12 and an inner defining surface 13, where the term "inner" signifies that it is turned to face towards an inner, central portion of the piece 1 of flooring material. The upper and lower defining surfaces 11 and 12, respectively, are suitably parallel with each other and with the upper surface 2 of the flooring piece 1 and its lower surface 3. The inner defining surface is substantially at right angles to the plane of extent of the flooring piece and has more or less rounded transitions to the upper and lower defining surfaces 11 and 12, respectively, of the groove.

Above the groove 9, the first piece 1 has an upper edge surface 14 which, in the illustrated embodiment, is at right angles to the upper side 2 of the flooring piece, and a lower edge surface 15 which may also be at right angles to the upper side 2 of the flooring piece, but which also, as is the case in FIG. 1, inclines somewhat outwards in a direction from above and downwards.

Beneath the groove 9, the first piece 1 has, in its profile, a projection 16 whose underside coincides with or may be seen as an extension of the lower surface 3 of the piece 1 proper. The projection 16 has an upper surface 17 which, with its inner end, connects to the lower edge surface 15 and which, with its outer end, connects to the outermost edge surface 18 of the flooring piece. The projection 16 is of lesser thickness transversely of the plane of extent of the first piece at its inner region where it connects to remaining parts of the first flooring piece than is the case at its outer region in connection with the outermost edge surface 18. This thus implies that a is <b. This also implies that the upper surface 17 will have an inclination so that it rises in a direction away from the central portion of the first piece out towards the outermost edge 18.

It will further be apparent from FIG. 1, that the distance e from the lower defining surface 12 of the groove and the underside 3 of the first piece is equal to or greater than the height b of the outer edge of the projection 16, i.e. e≧b. Further, the height d of the groove 9 and the distance c from its upper defining surface 11 up to the upper side 2 of the first piece 1 are approximately equal. Finally, it suitably further applies that e>d.

In the profile of the second flooring piece, there is provided above the tongue 10 a recess 19 which inwardly, i.e. in a direction towards the central portion of the piece 5, is defined by an edge surface 20 which, when pieces 1 and 5 are united, is disposed to abut against the upper edge surface 14 on the first piece 1. It is thereby at right angles to the upper surface 6 of the second flooring piece 5, which is parallel with its lower surface 7. Downwardly, the recess 19 is defined by the upper defining surface 21 of the tongue, which is parallel with the upper and lower surfaces 6 and 7, respectively, of the second flooring piece 5. The relative vertical position between the upper defining surface 11 of the groove 9 and the upper defining surface 21 of the tongue 10 is such that, when the first piece 1 and the second piece 5 are joined together on a planar substrate, surface contact prevails between the defining surfaces 11 and 21. In the same joined position, the edge surfaces 14 and 20 also abut against one another, so that a tight joint is formed.

On the underside of the tongue 10, there is a lower edge surface 22 which may be at right angles to the upper side 6 of the second flooring piece 5, but which may also incline in relation to the vertical plane inwards in a direction from above and downwards.

For accommodating the projection 16 on the first piece, the second piece has a recess 23 which is defined inwardly by an inner edge surface 24 and which is defined upwardly by an upper defining surface 25. The cross-sectional forms of the projection 16 and the recess 23 are either identical with one another or possibly complementary with one another.

In a first embodiment, the upper surface 17 of the projection 16 abuts, when pieces 1 and 5 are joined together, against the upper defining surface 25 of the recess 23. On the other hand, there is, between the outermost edge surface 18 and the inner edge surface 24, a narrower gap, which also applies to the lower edge surface 15 of the first piece and the lower edge surface 22 of the second piece. The reason for these gaps is to ensure a surface contact between the upper edge surface 14 on the first piece and the upper edge surface 20 on the second piece. The advantage is thereby afforded that the joint 28 (FIGS. 4 and 5) between the upper surfaces 2 and 6 of both pieces will be tight.

Normally, the core material in the two pieces 1 and 5 consists of MDF-panel, HDF-panel or similar panel material. The surface structure in such material will, on machining, be of such a nature that the friction between the two obliquely inclined surfaces 17 (on the projection 16) and 25 (at the recess 23) will be considerable. In addition to this frictional force, there will also be the frictional force between the upper defining surface 11 of the groove and the upper defining surface 21 of the tongue 10.

In that the upper surface 17 of the projection 16 inclines upwards in a direction away from the central portion of the first piece, the second piece 5 must be lifted if an attempt is made to separate the two flooring pieces. However, such a lifting is prevented by the abutment of the tongue 10 against the upper defining surface 11 of the groove 9. In such a case, there only remains a separation possibility if the two pieces are angled somewhat in relation to one another as intimated in FIGS. 3 and 4. The inclination of the upper surface 17 of the projection 16 and the upper defining surface 25 at the recess 23 thus entails that, in a laid, joined floor, the pieces 1 and 5 may be said to mechanically interlock. Expressed otherwise, the inclination implies that the normal force, and thereby the friction between the surfaces 17 and 25 increases if an attempt is made to shift away from one another two pieces 1 and 5 of the flooring material laying flat on a sub-floor.

In order to improve the joining together of the two pieces 1 and 5, it is naturally, as far as is possible, a matter of preventing a relative slipping between the upper surface 17 of the projection and the upper surface 25 of the recess 23. For this reason, one or both of the above-mentioned surfaces is provided with a slip-preventing or slip-impeding treatment or coating. Expressed otherwise, this implies that either or both of the surfaces 17 and 25 are coated with an agent which is adhesive, locking, elastic or resilient and which, for example, may consist of neoprene, resin, colophony (rosin) or a non-setting acrylic-based or silicon based sealant. Another coating with the same purpose may be realized if either or both of the surfaces are coated with a layer of binder, in which grains or small particles of sand, stone, glass or metal are then embedded.

In the embodiment according to FIGS. 3–5, the slip-preventing or slip-impeding treatment or coating is shown as a flock which is disposed on either or both of the surfaces 17 and 25. In this context, the term flock is taken to signify a surface coating which includes a base layer of a suitable binder in which a large number of short fibers are secured so that they extend out from the base layer, in certain cases at right angles thereto. Such a flock can be achieved if the surface is coated with a tacky layer of the base coating, the fibers are charged electrostatically and applied, for example, by blowing, on the binder layer, whereafter the electrostatic charge is maintained so that the fibers extend out from the binder layer while this dries or sets.

In the embodiment according to FIGS. 3–5, the distance between the upper surface 17 of the projection 16 and the upper defining surface 25 of the recess 23 is sufficiently great to accommodate both the fibers included in the flock and its bonding layer. A suitably adapted tolerance is such that a certain normal force prevails between the two surfaces in the joined position of the flooring pieces 1 and 5. This normal force also gives rise to a normal force between the upper surface 11 of the groove and the upper surface 21 of the tongue. The same tolerances are also suitable in the other described embodiments.

It will further be apparent from FIG. 5 that the outer edge 27 of the tongue has a slight distance to the inner defining surface 13 of the groove, and that there is further, between the lower edge surfaces 15 and 22, a small gap, as also applies between the outermost edge surface 18 and the inner edge surface 24. These gaps have been provided with a view to guaranteeing a tight joint 28 between the upper surfaces 2 and 6 of the flooring pieces.

It was mentioned above that the inclination of the upper surface 17 of the projection 16 and the upper defining surface 27 of the recess 23 gives an interlocking mechanical engagement between two joined pieces 1 and 5 as long as these lie flat on a substrate 4. In order to realize convenient laying of the pieces, the tongue 10 has, on its underside, a bevel or rounding so that, in the vertical direction, it is thinner at its outer end 27 than is the case at its root between the edge surfaces 20 and 22. This implies that, in the mounted state (FIG. 5) under the tongue 10, there is still a cuneiform space 29 in the groove 9 on the underside of the tongue 10. In the Figures, the underside 30 of the tongue 10 has been shown as approximately planar and directed with an angle of inclination which is approximately equal to the angle of inclination of the upper defining surface 25 of the recess 23 but counter-directed. Another way of expressing the bevelling or rounding would imply that the lower defining surface 30 of the tongue, for the greater part, is to be located over an arc with the center in the joint 28 and a radius which extends down to the line of intersection between the lower defining surface 12 of the groove and the upper edge of the lower edge surface 15.

In that the lower surface 30 of the tongue 10 has been beveled or rounded in the described manner, the second flooring piece 5 may be simply joined together with the first when this is lying flat on a substrate 4 if the second piece is angled upwards somewhat as shown in FIGS. 3 and 4. The reverse naturally also applies, in that the second piece may readily be removed from the first by its one edge being lifted so that the second flooring piece is angled upwards.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An arrangement which comprises: first and second panel-shaped pieces of flooring for joining together, said pieces resting on a sub-floor and having profiles along mutually meeting edge portions which, on the first piece, consist of a groove and a projection located thereunder, and on the second piece, a tongue insertible in the groove, and recess located under the tongue for accommodating the projection; wherein said projection, has one continuous recess contacting upper surface extending in a downward direction from an outer, free edge of the projection to a location substantially right below an open end of the groove, the upper surface having an outer edge and an inner edge and a surface which mates with the recess and slopes from the outer edge downwardly toward the inner edge.

2. An arrangement which comprises: first and second panel-shaped pieces of flooring for joining together, said pieces resting on a sub-floor and having profiles along mutually meeting edge portions which, on the first piece, consist of a groove and a projection located thereunder, and on the second piece, a tongue insertible in the groove, and a recess located under the tongue for accommodating the projection; wherein said projection has one continuous recess contacting upper surface extending in a downward direction from an outer, free edge of the projection to a location substantially right below an open end of the groove, wherein the upper surface of the projection mates with a surface defining the recess and at least one of the surface has a slip-preventing coating.

3. The arrangement as claimed in claim 2, wherein the recess is upwardly defined by an upper defining surface which is substantially complementary to the upper surface of the projection when the pieces are joined together.

4. The arrangement as claimed in claim 3, wherein the upper surface of the projection and the upper defining surface of the recess are substantially planar.

5. An arrangement which comprises: first and second panel-shaped pieces of flooring for joining together, said pieces resting on a sub-floor and having profiles along mutually meeting edge portions which, on the first piece, consist of a groove and a projection located thereunder, and on the second piece, a tongue insertible in the groove, and a recess located under the tongue for accommodating the projection; wherein said projection has one continuous recess contacting upper surface extending in a downward direction from an outer, free edge of the projection to a location substantially right below an open end of the groove wherein the thickness of the projection at the outer, free edge is greater than the thickness of the projection at the location below the groove; and wherein the underside of the projection lies flush with the remainder of the underside of the flooring piece.

6. The arrangement as claimed in claim 1 or 5, wherein, at least one of the upper surface of the projection and the upper defining surface of the recess have a slip-preventing or slip-impeding treatment or coating.

7. The arrangement as claimed in claim 6, wherein the slip-preventing or slip-impeding coating is a flock.

8. The arrangement as claimed in claims 1, 2 or 5, wherein the tongue has, on its underside, a bevel so that it will be thinner in the vertical direction in a direction out towards its free edge, and wherein the angle which the bevel makes with the plane of extent of the second piece is counter-directed and approximately of the same magnitude as an angle of inclination which is defined by the difference in thickness between the outer and inner edge regions of the projection.

9. The arrangement as claimed in claims 1, 2 or 5, wherein the outer edge of the upper side of the projection is approximately of the same vertical height above the lower surface of the first piece as the lower defining surface to the groove.

10. The arrangement as claimed in claims 1, 2 or 5, wherein the second piece has, in direct conjunction with the underside of the tongue, an edge surface which is transversely directed in relation to the plane of extent of the flooring piece.

* * * * *